US005467952A

United States Patent [19]

Martin

[11] Patent Number: 5,467,952

[45] Date of Patent: Nov. 21, 1995

[54] WRIST SUPPORT FOR A KEYBOARD

[76] Inventor: John R. Martin, 5635 Nebeshonee La., Rockford, Ill. 61103

[21] Appl. No.: 141,983

[22] Filed: Oct. 28, 1993

[51] Int. Cl.[6] ..... B43L 15/00

[52] U.S. Cl. ..... 248/118.1; 248/346.01; 248/918

[58] Field of Search ..... 248/118, 118.1, 248/118.3, 118.5, 346, 918, 687, 345.1, 678, 506; 400/715, 718; 132/73

[56] References Cited

U.S. PATENT DOCUMENTS

| | | | |
|---|---|---|---|
| 4,482,064 | 11/1984 | Berke et al. | 248/118 X |
| 4,920,896 | 5/1990 | Holden | 248/345.1 X |
| 5,050,826 | 9/1991 | Johnston | 248/118.3 |
| 5,074,511 | 12/1991 | Wilson | 248/918 X |
| 5,108,057 | 4/1992 | Dandy, III et al. | 248/118 |
| 5,125,606 | 6/1992 | Cassano et al. | 248/918 X |
| 5,183,230 | 2/1993 | Walker et al. | 248/118 |
| 5,193,925 | 3/1993 | Fowke | 248/118 X |
| 5,197,699 | 3/1993 | Smith et al. | 248/118 |
| 5,203,527 | 4/1993 | Rubey | 248/918 X |
| 5,228,655 | 7/1993 | Garcia et al. | 248/918 X |
| 5,234,186 | 8/1993 | Powell | 248/918 X |

FOREIGN PATENT DOCUMENTS

| | | | |
|---|---|---|---|
| 93/21019 | 10/1993 | WIPO | 248/118.1 |

*Primary Examiner*—Karen J. Chotkowski
*Attorney, Agent, or Firm*—McAndrews, Held & Malloy

[57] ABSTRACT

A device for supporting a keyboard user's wrists while typing-or entering data at a keyboard is disclosed. The wrist supporting device includes a flexible tubular member fastened, with blind fasteners, to a tray on which keyboard rests. The top surface of the tubular member is positioned horizontally, in normally fixed relation above and along the front edge of the keyboard. The tubular member is made from a flexible material such as conventional polyurethane or vinyl tubing, that allows the top surface of the member to flex toward the top edge of the keyboard when the user's wrists are resting on the member.

12 Claims, 2 Drawing Sheets

WRIST SUPPORT FOR A KEYBOARD

FIELD OF THE INVENTION

The present invention relates to a wrist support device for use with a keyboard or similar articles. Personal computer keyboards and typewriters are two types of keyboards with which such devices may be used.

BACKGROUND OF THE INVENTION

Many typists or other persons using a keyboard often suffer forearm muscle strain by reason of their typing or key stroking over long periods of time. Carpal tunnel syndrome is an acute form of this type of strain or injury.

Wrist support devices, which help relieve the strain on the forearm muscles of a typist, are known. Typically existing support devices have been attached to the front end of the keyboard. Existing devices include support surfaces that are either approximately at the level of the keyboard front edge or below the front edge. There are problems with these existing types of wrist support devices.

The first problem is that the wrist supports are generally positioned too low, in relation to the keyboard, to provide adequate support for a keyboard user's wrists. These devices also provide only a small amount of support, and as noted, at a low position. Hence, keyboard user's may still suffer forearm muscle strain as a result of using these devices. Additionally, such users resting their wrists on these existing devices, are often not typing with correct form because the wrist support is too low.

The second problem with existing wrist support devices is that they are rigid. These devices do not flex sufficiently as a keyboard user applies pressure on the device while moving his or her wrists along the keyboard and while stretching his or her fingers to reach the keys on the upper rows of a keyboard. Because of their rigidity, these support devices can themselves contribute to forearm muscle strain. Such wrist supports are also uncomfortable.

SUMMARY OF THE INVENTION

Accordingly, one object of my present invention is to provide an improved wrist support device for use with a keyboard where the wrist supporting surface is positioned above the front edge of the keyboard. A related object of my present invention is to provide an improved wrist support device, as described, where the support surface assists a user in utilizing correct typing form.

Another object of my present invention is to provide an improved wrist support device for use with a keyboard, where the support surface affords a flexible support for a keyboard user's wrists. A related object of my invention is to provide an improved wrist support device, as described, where the support is more comfortable than those devices currently available, where use of the support will not abrade or irritate the user's wrists or the palms of his or her hands and where the support may be flexed forward, without requiring the keyboard user to slide his or her wrists forward relative to the support, so as to enable the user to reach the keys on the upper rows of a keyboard without stretching or strain.

These and other objects advantages and features of my invention will become apparent from the following drawings, which illustrate the preferred embodiment of my invention, and from the following description of the preferred embodiment of my invention.

DETAILED DESCRIPTION OF THE PREFERRED EMBODIMENT

While my invention will be described in connection with its preferred embodiment, it will be understood that I do not intend to limit the invention to that embodiment. Rather, I intend to cover all alternatives, modifications and equivalents within the spirit and scope of the invention as defined by the appended claims.

Figure 1:
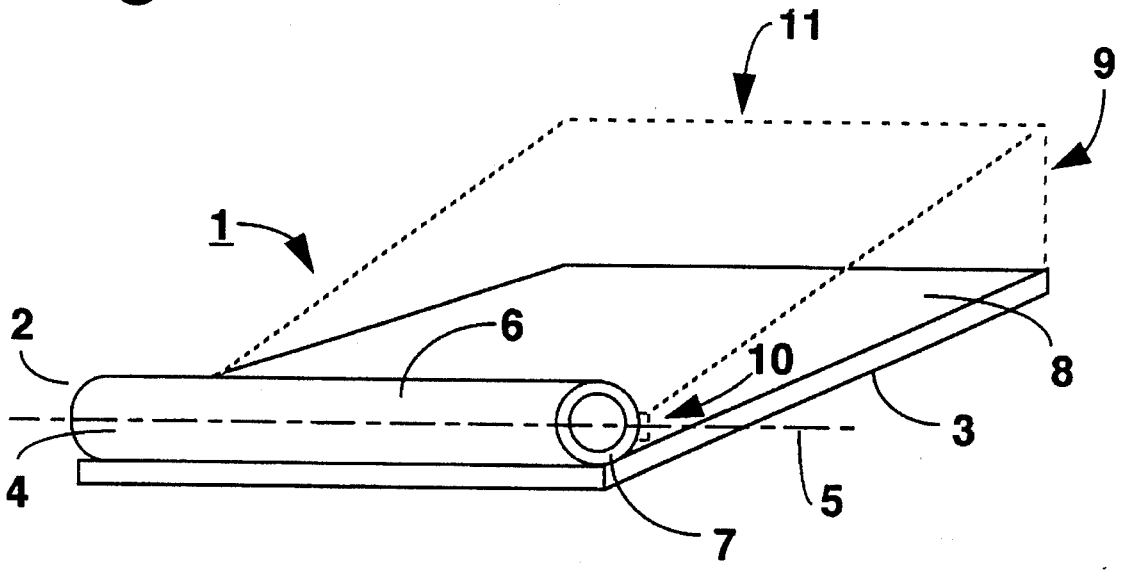
FIG. 1 is a perspective view of the preferred embodiment of my improved wrist support device, shown positioned for use with a keyboard which is shown in phantom lines.

Turning to FIG. 1, my improved wrist support device 1 includes a horizontally disposed tubular member 2 that is fastened to a tray 3. The tubular member 2 is made from a material (such as industrial polyurethane tubing or industrial vinyl tubing) such that it has a flexible, non-abrasive outer wall 4. The member 2 may also be made from a solid cylindrical piece of polyurethane or vinyl. The member 2 includes a horizontal center line 5, a top surface 6, and a lower mounting portion 7. At least the top surface 6, but preferably the entire outer surface of the member, should be smooth so as not to abrade or irritate the user's wrists or palms of his or her hands.

The tray 3 has upper facing surface 8 and may be made from of any material suitable for supporting a keyboard 9. Such materials include plastic, wood or metal. As shown in FIG. 1, the keyboard 9 is adapted to be supported on this upper tray surface 8. The keyboard 9 has a lower or front edge 10 and an upper or back edge 11 that is normally aligned with the upper edge of the tray 3.

Figure 2:
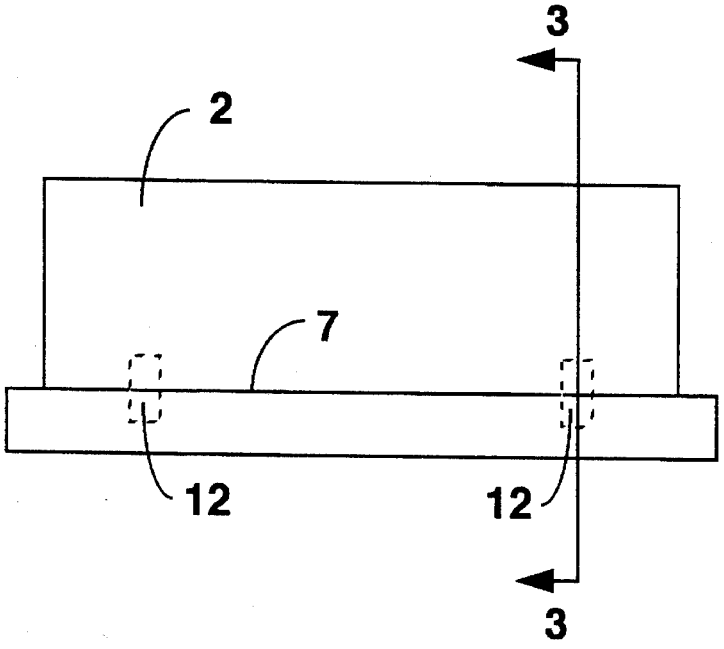
FIG. 2 is a front elevational view of the improved wrist support of FIG. 1.
Figure 3:
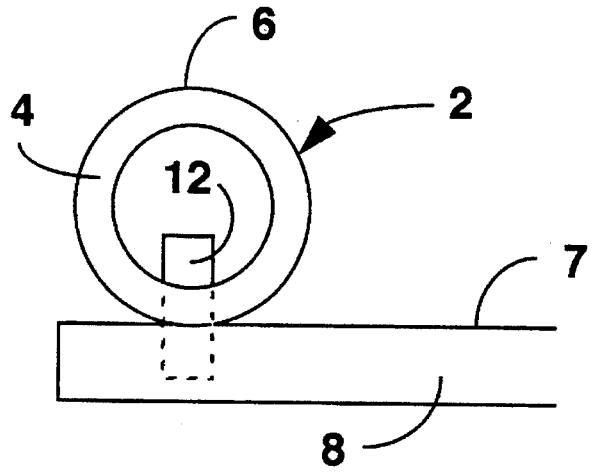
FIG. 3 is a cross-sectional view taken along the line 3—3 of FIG. 3.
Figure 4:
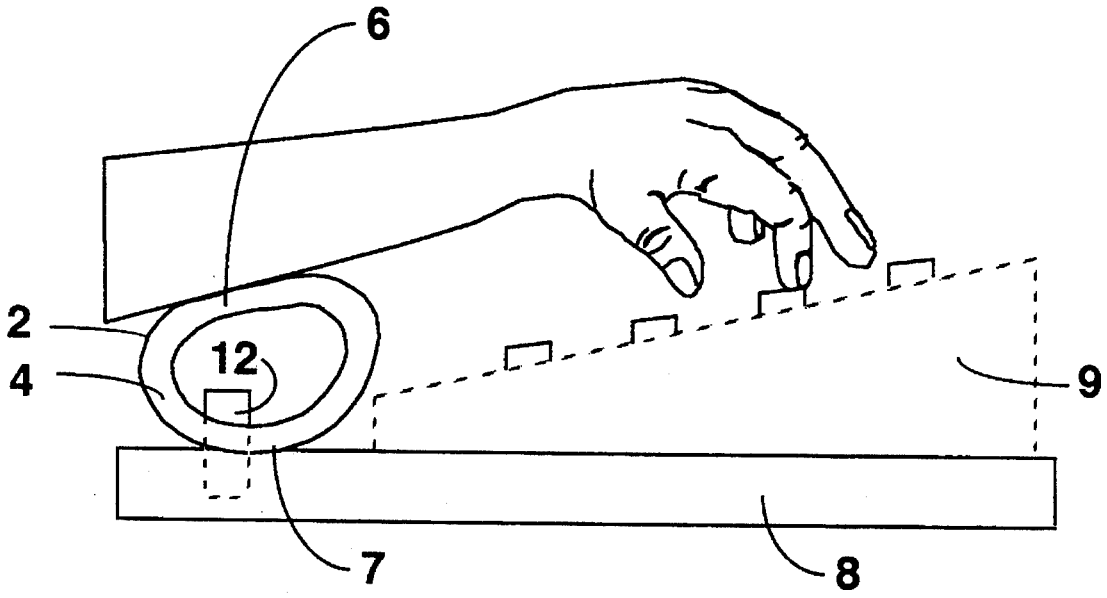
FIG. 4 is a fragmentary, side elevational view of my improved wrist support device, shown in a flexed position.

As best shown in FIGS. 2–4, the member 2 is fastened or secured to the upper facing surface 8 of the tray 3. A plurality (two being shown of conventional, "blind" fasteners 12 are used to secure the member 2, at its mounting surface 7, to the tray 3, between its ends, with the member 2 being aligned with and adjacent to the lower edge 10 of the keyboard 9. The fasteners 12 penetrate both the tray 3 and the member 2 as shown in FIGS. 2 and 3. Such blind fasteners 12 may include rivets, screws, an adhesive bond, or any other conventional fasteners or fastenings.

The top surface 6 of the member 2 is disposed, in a normally fixed relation, above the lower edge 10 of the keyboard 9 when as noted, the keyboard rests on the tray surface 8. A typist or keyboard user places or rests his or her wrists on the top surface 6 while typing or entering data. In this position, the member 2 provides support to the keyboard user's wrists while permitting him or her to use correct typing or data entry form. The user may easily slide his or her wrists, along or toward or away from the keyboard 9, while his or her wrists are supported by top surface 6 of the member 2. Such toward and away movement will most likely occur when the keyboard user is reaching for keys near the top edge 11 of the keyboard 9. Because the top surface 6 of the member 2 is part of the flexible outer wall 4, it will flex, as generally illustrated in FIG. 4, in response to the force exerted by the keyboard user. In sum, the keyboard user will receive the desired and necessary wrist support from the top surface 6 of the member 2 without having to exert pressure against a rigid, hard surface such as those used in existing wrist support devices.

The top surface 6 of the member 2 may be disposed at any convenient height, such as ½ to 3 inches, above the center line 5 of the member 2, and is typically mounted so that the top surface 6 is above the front edge 10 of the keyboard 9. The disposition of the top surface 6 can be determined by selecting the diameter of the tubular member 2 vis-a-via the height of the edge 10 of the keyboard 9 above the upper surface of the tray 3. In other words, the diameter and position of the member 2 will determine how high its center line 5, and thus, it top surface, is relative to the height of the front edge 10 of the keyboard 9.

The length of the member 2 and the width of the tray 3 may vary, for example, from 5 to 24 inches, although usually their length and width will generally coincide with the width of the keyboard 9. What is important is that the length of the member 2 allow the wrist support to accommodate persons using keyboards of various sizes and types such as a one-handed keyboard (which calculators commonly have) or a keyboard with a track-ball mounted to its side.

Although a keyboard tray 3 is provided in this preferred embodiment, this tray could be eliminated. In such an alternative, the member 2 could be mounted directly on the keyboard 9. Additionally and although the member 2 shown in FIG. 1 has a circular cross-sectional dimension it may, alternatively, have other generally cylindrical or comparable shapes so long as it affords a flexible top surface 6 for supporting the keyboard user's wrists.

I claim:

1. An improved device for supporting the wrists of a person using a keyboard, said keyboard including a front edge which is adjacent to the person during the person's use of the keyboard, a home row of keys, and a top row of keys, the improved device comprising:

a member having a top wrist supporting surface and having a flexible side wall for flexing towards the front edge of the keyboard so that the top wrist supporting surface may flex forward, while supporting the person's wrist during the person's use of the keyboard so that the person using the keyboard may shift from the home row of keys to the top row of keys while the top supporting surface supports the person's wrists; and means for mounting the member adjacent to the front edge of they keyboard and in a predetermined relationship to the keyboard.

2. The improved wrist support device of claim 1, wherein the top surface of the member is adapted to be disposed in a normally fixed, horizontal relation, above and along the front edge of the keyboard.

3. The improved wrist support device of claim 1, wherein the mounting means is a tray on which the keyboard rests; and wherein the member is mounted on the tray.

4. The improved wrist support device of claim 1, wherein the member is a tubular member.

5. The improved wrist support device of claim 1, wherein the mounting means includes a mounting surface disposed, at least in part, below the keyboard and in a normally fixed relation with respect to the keyboard.

6. The improved wrist support device of claim 1, which further comprises a tray having an upper surface adapted to support the keyboard; and wherein the member is secured to the upper surface of the tray.

7. The improved wrist support device of claim 6, wherein the member is a tubular member.

8. The improved wrist support device of claim 4 wherein said member is hollow.

9. The improved wrist support device of claim 1 wherein said flexible side wall has an unflexed position that permits said top supporting surface to support the person's wrists while using the home row of keys.

10. An improved device for supporting the wrists of a person using a keyboard, including a front edge, which is adjacent to the person during the person's use of the keyboard, the improved device comprising:

a tubular member having a top wrist supporting surface and having a flexible side wall so that the top wrist supporting surface may flex while supporting the person's wrist during the person's use of the keyboard;

a tray having an upper surface adapted to support the keyboard wherein said member is secured to said upper surface of said tray by a blind fastener and said member is adjacent to the front edge of the keyboard.

11. The improved wrist support device of claim 10, wherein the top surface of the member is adapted to be positioned in normally fixed horizontally disposed relation above and along the front edge of a keyboard; and wherein the length of the member extends substantially the length of the keyboard.

12. The wrist support of claim 11, wherein the member is made of plastic material.

* * * * *